US008583425B2

(12) United States Patent
Thepie Fapi et al.

(10) Patent No.: US 8,583,425 B2
(45) Date of Patent: Nov. 12, 2013

(54) METHODS, SYSTEMS, AND COMPUTER READABLE MEDIA FOR FRICATIVES AND HIGH FREQUENCIES DETECTION

(75) Inventors: Emmanuel Rossignol Thepie Fapi, Montreal (CA); Eric Poulin, Pierrefonds (CA)

(73) Assignee: Genband US LLC, Frisco, TX (US)

( * ) Notice: Subject to any disclaimer, the term of this patent is extended or adjusted under 35 U.S.C. 154(b) by 161 days.

(21) Appl. No.: 13/165,425

(22) Filed: Jun. 21, 2011

(65) Prior Publication Data

US 2012/0330650 A1 Dec. 27, 2012

(51) Int. Cl.
*G10L 11/00* (2006.01)

(52) U.S. Cl.
USPC ..... 704/206; 704/217

(58) Field of Classification Search
USPC ..... 704/206
See application file for complete search history.

(56) References Cited

U.S. PATENT DOCUMENTS 5,950,153 A * 9/1999 Ohmori et al. ..... 704/217
6,694,018 B1 * 2/2004 Omori ..... 379/406.03
2002/0138268 A1 * 9/2002 Gustafsson ..... 704/258
2002/0147579 A1 * 10/2002 Kushner et al. ..... 704/207
2003/0128793 A1 * 7/2003 Karino et al. ..... 376/254
2003/0211867 A1 * 11/2003 Bonnard et al. ..... 455/567
2004/0148160 A1 * 7/2004 Ramabadran ..... 704/221
2007/0016417 A1 * 1/2007 Sung et al. ..... 704/230
2008/0281588 A1 * 11/2008 Akagi et al. ..... 704/223
2009/0144062 A1 * 6/2009 Ramabadran et al. ..... 704/500
2011/0153318 A1 * 6/2011 Rossello et al. ..... 704/208

OTHER PUBLICATIONS

Zero-Crossing Rates of Functions of Gaussian Processes, John T. Barnett and Benjamin Kedem, 1188 IEEE Transactions on Information Theory, Vol. 37, No. 4, Jul. 1991.*

* cited by examiner

*Primary Examiner* — Pierre-Louis Desir
*Assistant Examiner* — Jie Shan
(74) *Attorney, Agent, or Firm* — Fogarty, L.L.C.

(57) ABSTRACT

Methods, systems, and computer readable media for fricatives and high frequencies detection are disclosed. According to one method, the method includes receiving a narrowband signal. The method also includes detecting, using one or more autocorrelation coefficients, a high frequency speech component associated with the narrowband signal.

24 Claims, 8 Drawing Sheets

METHODS, SYSTEMS, AND COMPUTER READABLE MEDIA FOR FRICATIVES AND HIGH FREQUENCIES DETECTION

TECHNICAL FIELD

The subject matter described herein relates to communications. More specifically, the subject matter relates to methods, systems, and computer readable media for fricatives and high frequencies detection.

BACKGROUND

Conventional telephone networks, such as the public switched telephone network (PSTN) and some mobile networks, limit audio to a frequency range of between around 300 Hz and 3,400 Hz. For example, in a typical PSTN call, an analog audio signal is converted into a digital format, transmitted through the network, and converted back to an analog signal. For instance, the analog signal may be processed using 8-bit pulse code modulation (PCM) at an 8,000 Hz sample rate, which results in a digital signal having a frequency range of between around 300 Hz and 3,400 Hz. Generally, a signal having a frequency range of between around 0 Hz and 4,000 Hz is consider a narrowband (NB) signal.

In contrast, a wideband (WB) signal may have a greater frequency range, e.g., a frequency range between around 0 Hz and 8,000 Hz or greater. A WB signal generally provides a more accurate digital representation of analog sound. For instance, the available frequency range of a WB signal allows high frequency speech components, such as portions having a frequency range between 3,000 Hz and 8,000 Hz, to be better represented. While an NB speech signal is typically intelligible to a human listener, the NB speech signal can lack some high frequency speech components found in uncompressed or analog speech and, as such, the NB speech signal can sound less natural to human listeners.

High frequency speech components are parts of speech, or portions thereof, that generally include frequency ranges outside that of an NB speech signal. For example, fricatives, e.g., the "s" sound in "sat," the "f" sound in "fat," and the "th" sound in "thatch," and other phonemes, such as the "v" sound in "vine" or the "t" sound in "time", may be high frequency speech components and may have at least some frequencies above 3000 or 4000 Hz. When fricatives and other high frequency components are processed for an NB speech signal, some portions of the high frequency components (referred to hereinafter as missing frequency components) may be outside the frequency range of the NB speech signal and, therefore, not included in the NB signal. Since high frequency speech components may be only partially captured in an NB speech signal, clarity issues that can annoy human listeners, such as lisping and whistling artifacts, may be introduced or exacerbated in the NB speech signal.

Bandwidth extension (BWE) generally involves artificially extending or expanding a frequency range or bandwidth of a signal. For example, BWE algorithms may be usable to convert NB signals to WB signals. BWE algorithms are especially useful for converting NB speech signals to WB speech signals at endpoints and/or gateways, such as for interoperability between PSTN networks and voice over Internet protocol (VoIP) applications.

Detection of speech frames with high frequency speech components can be useful for generating, from an NB speech signal, a WB speech signal having enhanced clarity. For example, by detecting speech frames containing high frequency speech components and estimating missing frequency components associated with such speech frames, such as a, speech quality and sound clarity can be enhanced in a generated WB speech signal. For instance, lisping and whistling characteristics found in the NB speech signal can be alleviated in the generated WB speech signal, thereby making the WB speech signal more natural and pleasant to human listeners.

Accordingly, in light of these difficulties, a need exists for improved methods, systems, and computer readable media for fricatives and high frequencies detection.

SUMMARY

Methods, systems, and computer readable media for frequency detection are disclosed. According to one method, the method includes receiving a narrowband signal. The method also includes detecting, using one or more autocorrelation coefficients, a high frequency speech component associated with the narrowband signal.

A system for frequency detection is also disclosed. The system includes an interface for receiving a narrowband signal. The system also includes a frequency detection module for detecting, using one or more autocorrelation coefficients, a high frequency speech component associated with the narrowband signal.

The subject matter described herein may be implemented in software in combination with hardware and/or firmware. For example, the subject matter described herein may be implemented in software executed by a processor. In one exemplary implementation, the subject matter described herein may be implemented using a computer readable medium having stored thereon computer executable instructions that when executed by the processor of a computer control the computer to perform steps. Exemplary computer readable media suitable for implementing the subject matter described herein include non-transitory devices, such as disk memory devices, chip memory devices, programmable logic devices, and application specific integrated circuits. In addition, a computer readable medium that implements the subject matter described herein may be located on a single device or computing platform or may be distributed across multiple devices or computing platforms.

As used herein, the term "node" refers to a physical computing platform including one or more processors and memory.

As used herein, the term "signal" refers to a digital representation of sound, e.g., digital audio information embodied in a non-transitory computer readable medium.

As used herein, the terms "function" or "module" refer to software in combination with hardware (such as a processor) and/or firmware for implementing features described herein.

BRIEF DESCRIPTION OF THE DRAWINGS

The subject matter described herein will now be explained with reference to the accompanying drawings of which.

DETAILED DESCRIPTION

Figure 1:
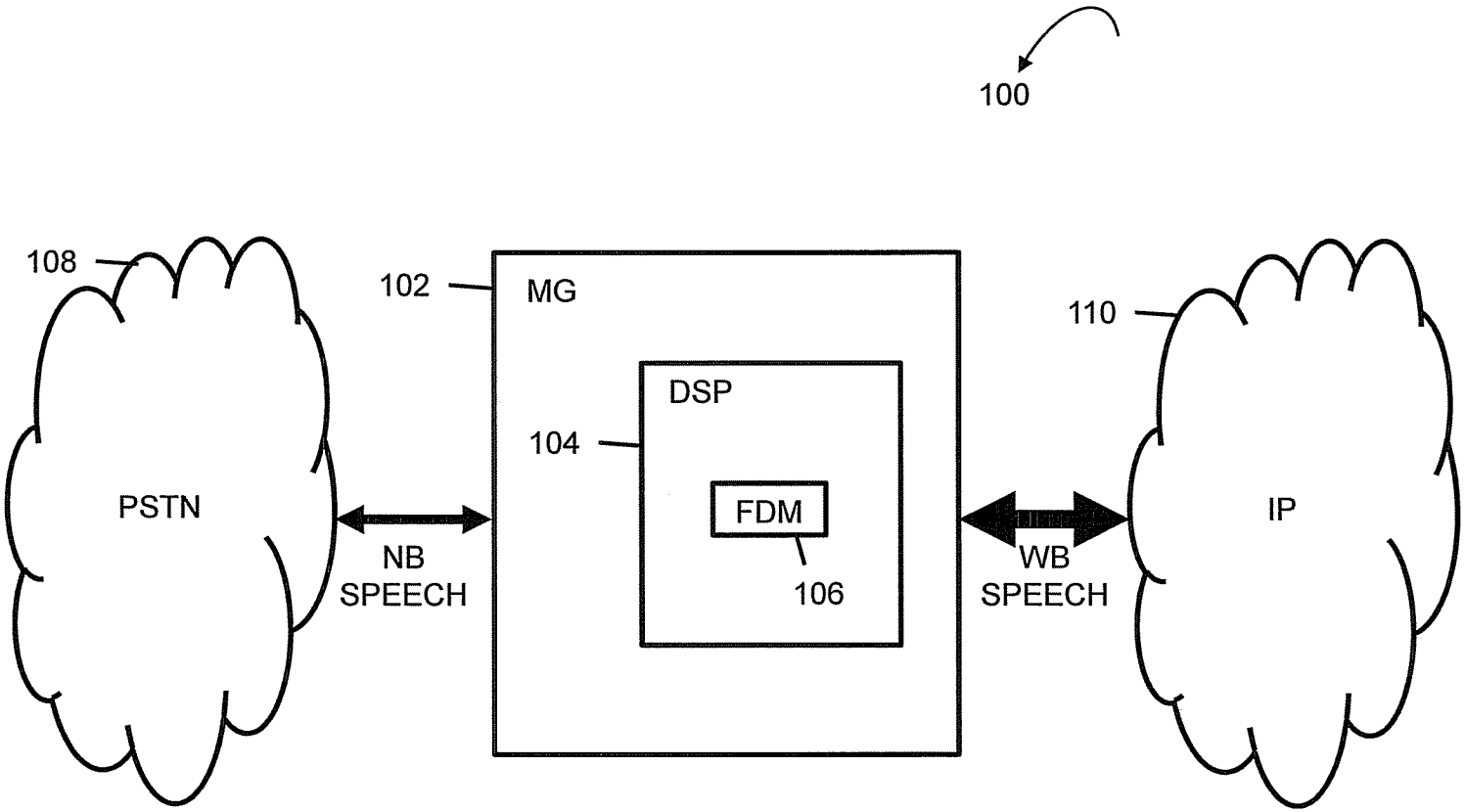
FIG. 1 is a block diagram illustrating an exemplary node having a frequency detection module (FDM) according to an embodiment of the subject matter described herein.

The subject matter described herein includes methods, systems, and computer readable media for fricatives and high frequencies detection. According to one aspect, the present subject matter described herein may use autocorrelation coefficients (ACs) to detect high frequency speech components, including fricatives, associated with a narrowband (NB) speech signal. For example, the difference between a given NB speech signal and its associated wideband (WB) version may be related to the proportion of high frequency components (also referred to as high bands) when compared to low frequency components (also referred to as low bands). It has been determined that ACs for portions (e.g., frames) of NB speech signal and ACs for portions of an associated WB speech signal have significant differences when the portions have large ratios of high bands to low bands. For example, frames containing unvoiced or voiceless fricatives (like the "s" sound in "sat"), typically have large ratios of high bands to low bands. Such large ratios may be determined by performing a zero-crossing rate analysis using ACs.

ACs associated with an NB speech signal may be used to detect speech frames (e.g., 20 milliseconds (ms) portions of a digital speech signal) containing high frequency speech components, or portions thereof. Since high frequency speech components (e.g., speech components having frequency ranges of between around 3,000 Hz and 8,000 Hz) are missing or incomplete in an NB speech signal, detecting frames that contain high frequency speech components and processing these frames to approximate missing frequency components is useful in accurately reproducing a more natural sounding speech signal (e.g., a WB signal).

Advantageously, performing frequency detection using ACs can be more efficient (e.g., use less resources) and faster than conventional methods. For example, on a per frame basis, detecting high frequency speech components using ACs may involve manipulating 17 parameters (e.g., ACs at 17 different lag times) while conventional methods may involve using 384 or more parameters (e.g., speech samples of a PCM-based signal). Moreover, conventional methods use transformations, such as fast Fourier transformations (FFT) and speech energy estimation based on PCM speech samples which are computationally expensive and can be a source of delay. By detecting high frequency speech components using ACs, conventional FFT and speech energy estimation may be avoided, thereby greatly reducing computational load. Another advantage in using ACs in performing frequency detection is that many current signal processing algorithms (e.g., code excited linear prediction (CELP) codecs like codecs used in Global System for Mobile Communications (GSM) networks) already compute ACs for other purposes, such as for linear prediction coding (LPC) analysis. As such, in some instances, previously computed ACs may be used in performing frequency detection.

Additionally, frequency detection as described herein may be robust against background noise. For example, ACs computed based on a corrupted or noisy speech signal may be only slightly different than ACs computed based on a clean or non-noisy speech signal. As such, a frequency detection algorithm that uses ACs to detect high frequency speech components may be minimally affected.

Reference will now be made in detail to exemplary embodiments of the subject matter described herein, examples of which are illustrated in the accompanying drawings. Wherever possible, the same reference numbers will be used throughout the drawings to refer to the same or like parts.

FIG. 1 is a block diagram illustrating an exemplary node having a frequency detection module (FDM) according to an embodiment of the subject matter described herein. Referring to FIG. 1, an exemplary network 100 may include a media gateway (MG) 102 and/or other communications nodes for processing various communications.

MG 102 represents an entity for performing digital signal processing. MG may include various interfaces for communicating with one or more nodes and/or networks. For example, MG 102 may include an Internet protocol (IP) or session initiation protocol (SIP) interface for communicating with nodes in an IP network 110 and a signaling system number 7 (SS7) interface for communicating with nodes in a public switched telephone network (PSTN) 108. MG 102 may also include various modules for performing one or more aspects of digital signal processing. For example, MG 102 may include a digital signaling processor (DSP) 104, a codec, and/or a FDM 106.

FDM 106 represents any suitable entity for performing one or more aspects of frequency detection, such as fricative or other high frequency speech component detection, as described herein. In some embodiments, FDM 106 may be a stand-alone node, e.g., separate from MG 102 or other communications node. In other embodiments, FDM 106 may be integrated with or co-located at a communications node, MG 102, DSP 104, and/or portions thereof. For example, FDM 106 may be integrated with a DSP 104 located at MG 102.

FDM 106 may include functionality for detecting high frequency speech components, such as fricatives, in an NB speech signal. For example, FDM 106 may process frames of an up-scaled NB speech signal and compute or retrieve ACs for each frame. For frames having appropriate content (e.g., frames that are not silent and ACs that are not similar), FDM 106 may perform a zero-crossing rate analysis using the ACs and determine whether each frame contains a high frequency speech component. By accurately detecting frames containing high frequency speech components and effectively estimating the missing frequency components associated with these frames, various improvements can be made in BWE and other applications where an original WB speech signal is to be approximated by generating missing or incomplete high frequency speech components of an NB speech signal.

Figure 2:
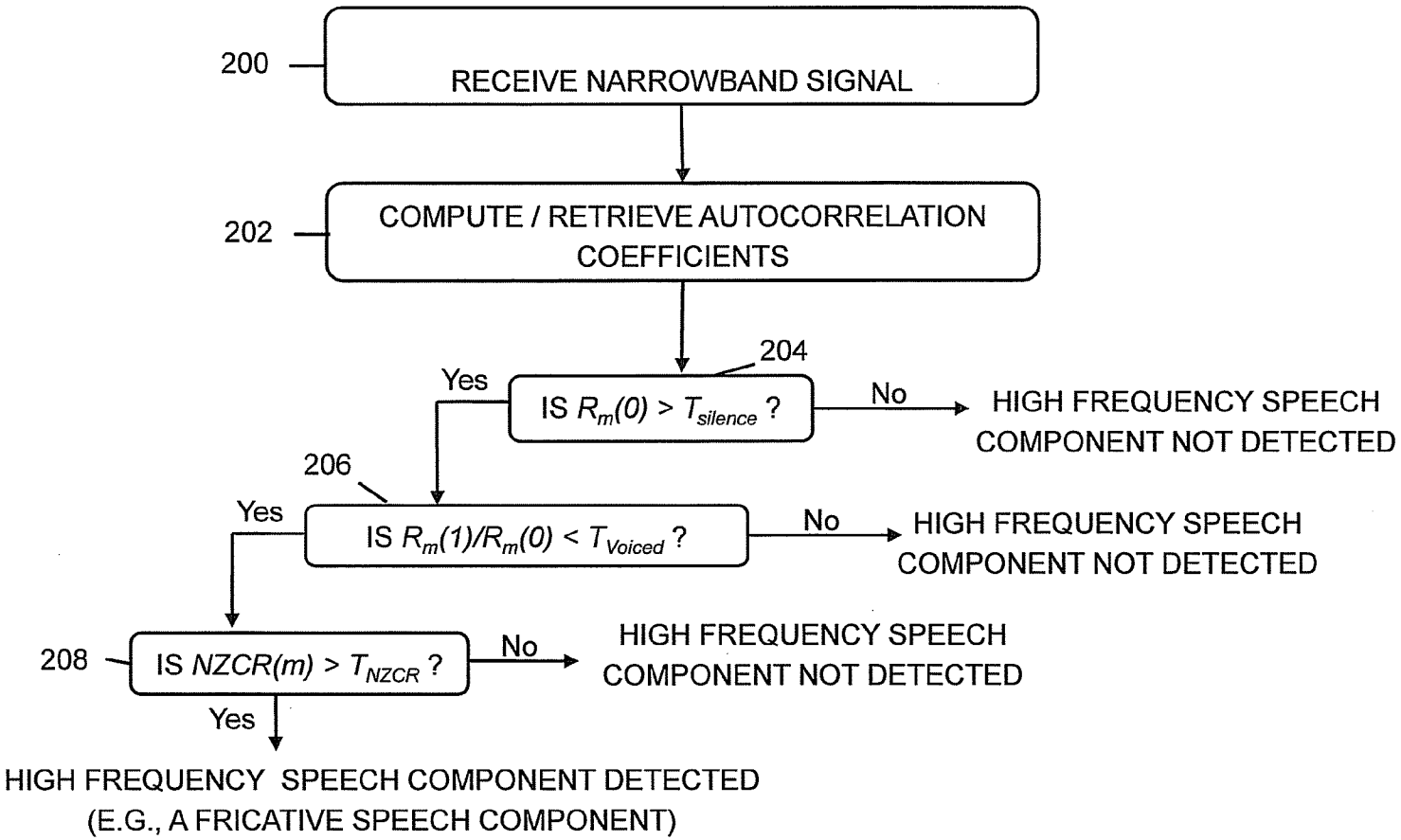
FIG. 2 is a flow chart illustrating an exemplary process for frequency detection according to an embodiment of the subject matter described herein.

FIG. 2 is a block diagram illustrating an exemplary process for frequency detection according to an embodiment of the subject matter described herein. In one embodiment, the exemplary process may occur at or be performed by a FDM 106. For example, a FDM 106 may include a processor (e.g., DSP 104), a codec, and/or a communications node. FDM may be a stand-alone node or may be integrated with one or more other nodes. For example, FDM 106 may be integrated with or co-located at MG 102 or another node. In another example, FDM 106 may be a stand-alone node separate from MG 102.

Referring to FIG. 2, in step 200, an NB signal may be received. NB signal may include speech or voice communications. In some embodiments, NB signal may be up-sampled to match a target WB sample rate. For example, an NB signal with an 8,000 Hz sample rate may be converted to an NB signal with a 12,800 or 16,000 Hz sample rate by FDM 106. In a second example, a second module or node may perform the up-sampling before providing the up-sampled NB signal to FDM 106.

In step 202, ACs may be computed or retrieved. For example, a PSTN speech signal may be received at MG 102, the received speech signal may be processed as frames and ACs may be computed for each frame. In some embodiments, each frame may be windowed (e.g., a frame may include information from adjacent frames) and the autocorrelation coefficients may be computed based on the windowed version of the frames. For example, windowing allows individual frames to be overlapped to prevent loss of information at frame edges. As such, a windowed frame may include information from adjacent frames.

Figure 3:
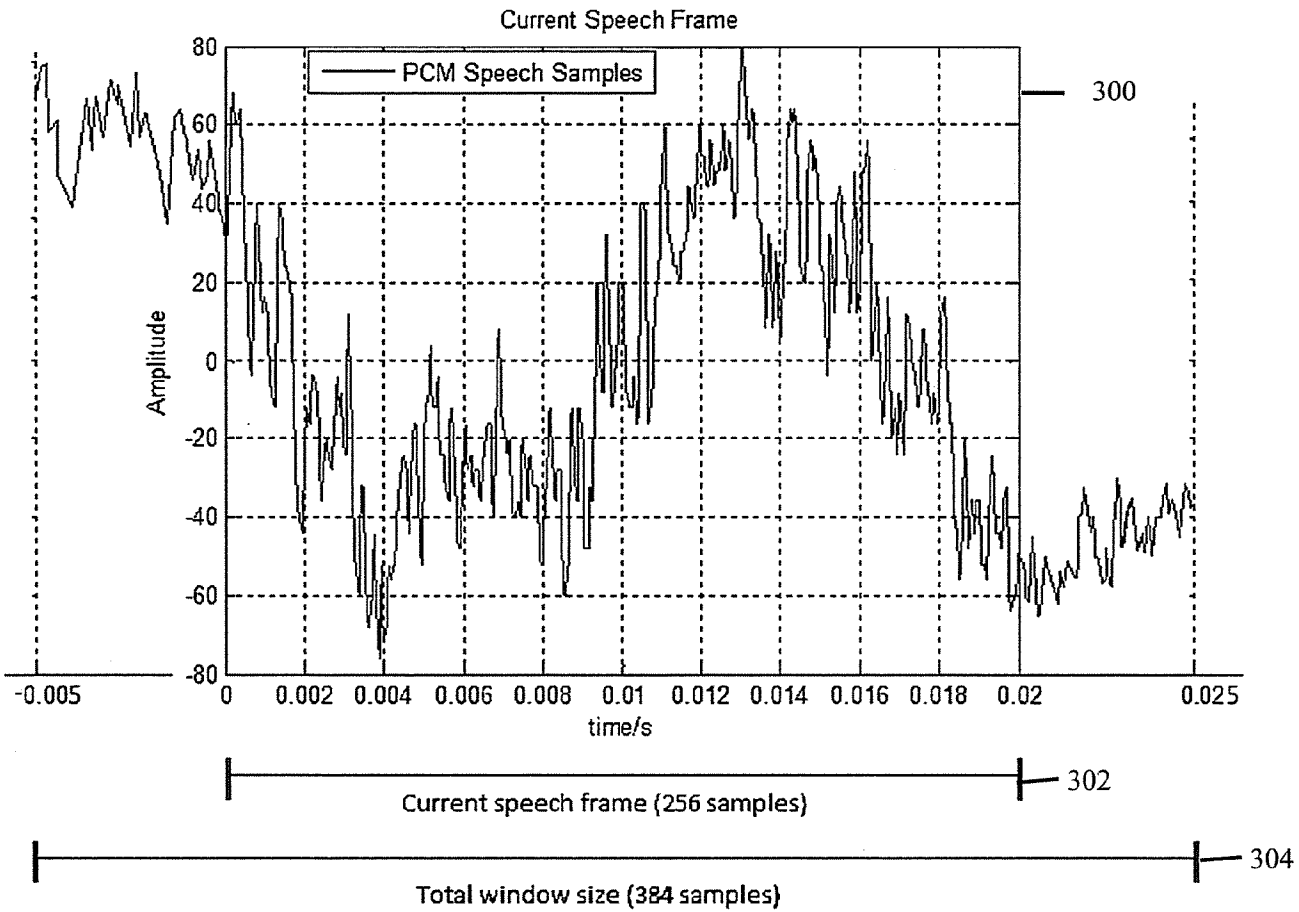
FIG. 3 is a diagram illustrating an exemplary windowed speech frame.

Reference will now be made to FIG. 3 with regard to windowing of a frame. Referring to FIG. 3, chart 300 depicts PCM samples of a speech signal portion having a 12,800 Hz sample rate. The size of the frame is indicated by line 302. In particular, line 302 indicates that the speech frame is 20 ms or 256 PCM samples (12,800 Hz×0.02 seconds). A windowed version of the frame is also shown. As indicated by line 304, the windowed version of the frame includes an additional 5 ms or 64 PCM samples at both the start and the end of the frame. Hence, line 304 indicates that the windowed version is 30 ms or 384 PCM samples (12,800 Hz×0.03 seconds).

ACs generally refer to values that indicate how well a series of values correlate to its past and/or future values. AC may be computed using various autocorrelation computation algorithms. For example, ACs may be computed by an Adaptive Multi-Rate-Wideband (AMR-WB) codec. Transcoding functions, including an autocorrelation computation algorithm, for an AMR-WB codec are specified in 3$^{rd}$ Generation Partnership Project (3GPP) technical specification (TS) 26.190 v10.0.0 (hereinafter referred to as the AMR-WB specification), the disclosure of which is incorporated herein by reference in its entirety.

Equation 1 (shown below) represents an exemplary short term autocorrelation formula for computing ACs. In Equation 1, $s_w(n)$ may represent a value associated with windowed speech signal, n may represent a series of integers between 1 and N, N may represent the number of samples of a windowed speech signal portion minus 1 (e.g., N=383 as specified in the AMR-WB specification), and j may represent lag, where lag is a time period between the start of a series of values (e.g., PCM samples) and the start of a time-shifted version of the same series of values used in performing autocorrelation.

For example, in Equation 1, j may be an integer between 0 and M. M may be the order of the analysis and may typically depend on the sample rate of the input signal (e.g., M may be 16 for a windowed speech signal at 12,800 Hz sample rate). In this example, lag 0 may represent cross-correlation between an input signal and an exact clone of the input signal with no lag, lag 6 may represent cross-correlation between the input signal and a version of the input signal that is delayed by around 0.49 ms or 6 PCM samples, and lag 16 may represent cross-correlation between the input signal and a version of the input signal that is delayed by around 1.25 ms or 16 PCM samples. The ACs values at different lags for a given frame may be referred to herein as an AC vector, e.g., $AC_{vector}$=[r(0), r(1), . . . , r(M)].

$$r(j) = \sum_{n=j}^{N-1} s_w(n) \cdot s_w(n-j) \qquad \text{Equation 1}$$

Figure 4:
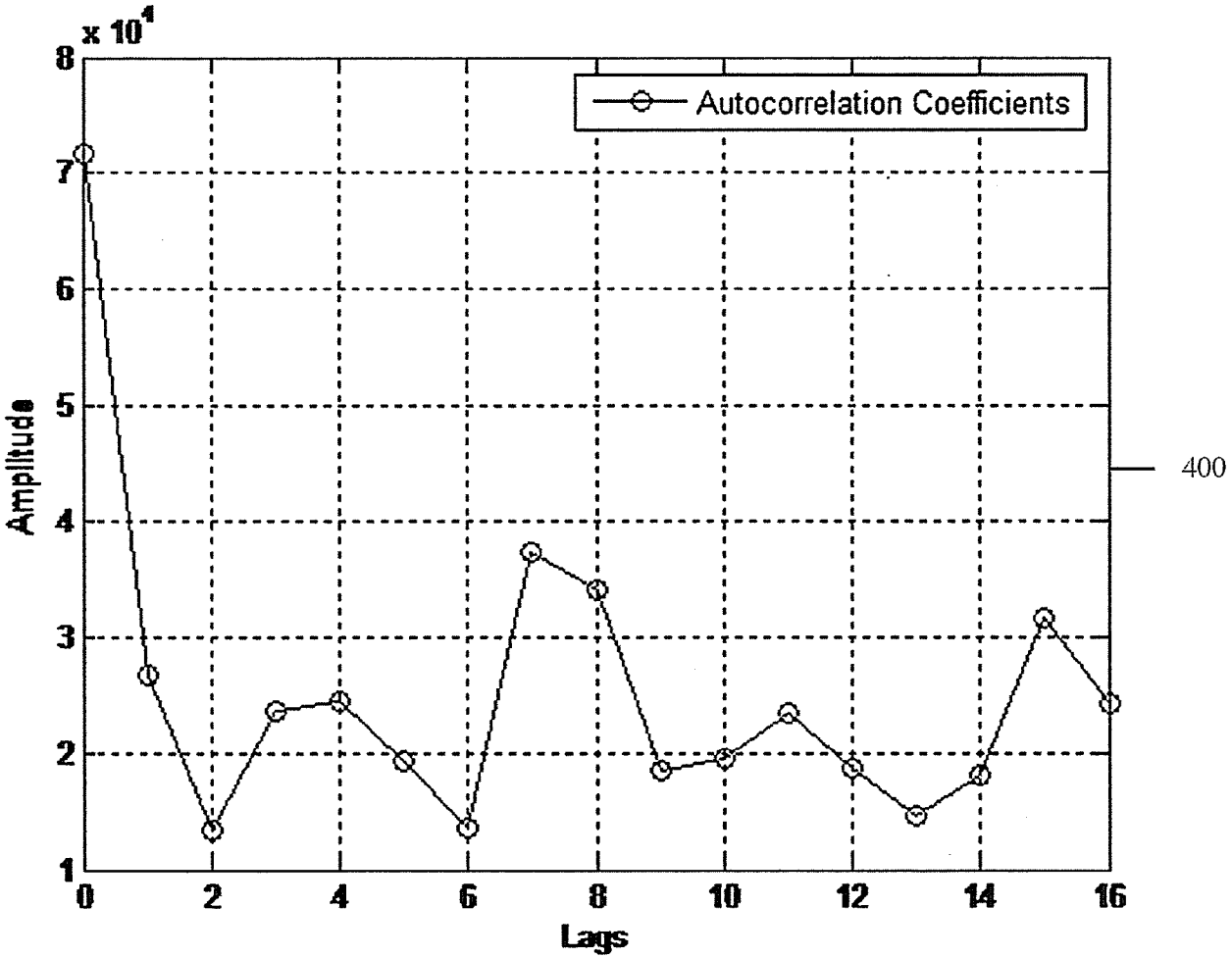
FIG. 4 is a diagram illustrating exemplary autocorrelation coefficients (ACs) values computed for a windowed speech frame.

FIG. 4 is a diagram illustrating exemplary ACs computed for a windowed speech frame. Referring to FIG. 4, chart 400 depicts ACs for an exemplary signal at various lags between 0 and 16. As stated above, AC at lag 0 represents a value indicating cross-correlation between a series of values and the exact same series of values. Hence, the energy level or amplitude is highest at AC at lag 0 and may be highly correlated with the overall energy of the frame. In some embodiments, AC at lag 0 may be usable for approximating variance of an input signal. In FIG. 4, the AC at lag 0 of the input signal is $7\times10^4$. ACs at lags 1-16 are significantly less than the AC at lag 0, their values ranging between $1\times10^4$ and $4\times10^4$.

In one embodiment, ACs may be retrieved, e.g., from a codec or storage. For example, a CELP algorithm or codec may compute ACs in generating LPC coefficients used for speech analysis and resynthesis. The computed ACs may be stored in memory, such as random access memory, and may be retrieved by FDM 106 or other module for frequency detection.

In another embodiment, ACs may be derived from LPC coefficients and/or other computations. For example, a CELP codec may compute ACs for computing LPC coefficients. The CELP codec may store the LPC coefficients, but may discard the ACs. In this example, FDM 106 or other module may be capable of deriving ACs from the LPC coefficients and/or other computations.

Referring back to FIG. 2, after ACs are computed or retrieved, in step 204, it may be determined whether the frame contains content indicative of speech (e.g., frame is non-silent). For example, FDM 106 may avoid further processing of silent frames or frames having poor spectral content. FDM 106 may use an AC that corresponds to signal power or variance, such as AC at lag 0 (i.e., $R_m(0)$), to determine whether a frame is silent or has poor spectral content. Using this AC, FDM 106 may compare the value with a silence or variance threshold ($T_{Silence}$). For example, in an environment where ACs are computed using an AMR-WB algorithm, the variance threshold may be around or between 10 $e^4$ and 25 $e^4$. In some embodiments, this threshold may be equivalent to a threshold used in classical (e.g., PCM-based) variance determinations. If the AC associated with the frame exceeds the threshold, it may be determined that the frame contains content indicative of speech and should be further processed.

Equation 2 (shown below) represents an exemplary formula for determining whether the frame contains content indicative of speech. For example, using Equation 2, if $R_m(0)$ value associated with a frame exceeds a variance threshold ($T_{silence}$), it is determined that the frame contains content indicative of speech and, as such, should be further processed to determine whether the frame contains a high frequency speech component.

$$R_m(0) > T_{Silence} \qquad \text{Equation 2}$$

The variance threshold may be preconfigured or dynamic. For example, a variance threshold may depend on various factors, such as encoder/decoder settings, communications equipment, and/or the algorithm used for computing ACs.

In step 206, after determining that a frame contains content indicative of speech, it may be determined whether the frame should be further processed. For example, strongly voiced phonemes, such as the "a" sound in "ape" or the "i" sound in "item", may be highly periodic in nature. Hence, a frame containing a strongly voiced phoneme may be highly correlated with lagged versions of itself. Hence, ACs computed based on such a frame may have similar values at different lags. As such, a frame containing a strongly voiced phoneme may hinder frequency detection and/or may yield little or no improvement when processed by a BWE algorithm to recover missing frequency components.

In some embodiments, it may be determined that frames containing strongly voiced phonemes should not be further processed. For example, FDM 106 may avoid processing frames believed to contain strongly voiced phonemes or other speech components that may not yield appropriate improvement, e.g., increased clarity, in a generated WB speech signal.

Equation 3 (shown below) represents an exemplary formula for determining whether a frame contains a strongly voiced phoneme. Referring to Equation 3, the ratio $R_m(1)/R_m(0)$ may be compared to an AC ratio threshold ($T_{voiced}$). For example, $R_m(1)$ or the AC at lag 1 may be divided by the $R_m(0)$ or the AC at lag 0 and the result may be compared to an AC ratio threshold value. If the $R_m(1)/R_m(0)$ ratio exceeds the AC ratio threshold, there may be a high probability that the frame contains a strongly voiced phoneme. As such, the frame may not be processed further with regard to frequency detection. However, if the $R_m(1)/R_m(0)$ ratio does not exceed the AC ratio threshold, the frame may be considered appropriate for further analysis.

The AC threshold ($T_{Voiced}$) may be preconfigured or dynamic and may depend on various factors, such as encoder/decoder settings, communications equipment, and/or the algorithm used for computing ACs. For example, in an environment where ACs are computed using an AMR-WB algorithm, the AC ratio threshold value may be 0.65.

$$\frac{R_m(1)}{R_m(0)} < T_{Voiced} \qquad \text{Equation 3}$$

In some embodiments, steps 204 and 206 may be combined, partially performed, not performed, or performed in various orders. For example, DFM 106 may determine whether a frame contains appropriate content for analysis. In this example, DFM 106 may perform either steps, both steps, or additional and/or different steps to determine whether a frame may contain a high frequency speech component.

After determining that the frame contains appropriate content and should be further processed, it may be determined whether the frame contains a high frequency speech component (e.g., a fricative speech component). In some embodiments, determining whether a frame contains a high frequency speech component may involve performing zero-crossing analysis. Zero-crossing analysis generally involves determining how many times the sign of a function changes, e.g. from negative to positive and vice versa. The number of times the sign of a function changes for a given period may be referred to as a zero-crossing rate.

Generally, high frequency speech components, such as fricatives, may be noise-like, non-periodic in nature, and poorly correlated with themselves. As such, high frequency detection using zero-crossing rate analysis may detect frames associated with high zero-crossing rates. Conventionally, a zero-crossing rate is computed based on PCM samples. According to an aspect of the present subject, zero-crossing rate may be computed using ACs. For example, simulations have shown a high correlation between zero-crossing rates computed based on PCM samples and zero-crossing rates computed based on ACs. As such, a zero-crossing rate computed using ACs may detect frames containing high frequency speech components.

Equation 4 (shown below) represents an exemplary formula for computing a normalized zero-crossing rate (NZCR) for a frame. Referring to Equation 4, a sign operation may be used. The sign operation may operate as follows: sign(x)=0 if x=0, sign(x)=+1 if x>0, and sign(x)=−1 if x<0. An NZCR of zero may indicate silence or frames having no high band content. The NZCR may increase when a considerable portion of the energy of the frame being analyzed is located in higher frequency components.

$$NZCR(m) = \frac{1}{M-1}\sum_{j=1}^{M-1}\frac{1}{2}\left|\text{sign}(R_m(j)) - \text{sign}(R_m(j-1))\right| \qquad \text{Equation 4}$$

In step 208, after an NZCR is computed for the windowed speech frame (e.g., frame m), the NZCR value ($NZCR(_m)$) may be compared to an NZCR threshold ($T_{NZCR}$). For example, it may be determined that a frame contains a high frequency speech component (e.g., a fricative speech component or portion thereof) if Equations 2 and 3 are satisfied and if the NZCR value associated with the frame exceeds an NZCR threshold.

$$NZCR(m) \leq T_{NZCR} \qquad \text{Equation 5}$$

The NZCR threshold ($T_{NZCR}$) may be preconfigured or dynamic and may depend on various factors, such as encoder/decoder settings, communications equipment, and/or the algorithm used for computing ACs. For example, an NZCR threshold ($T_{NZCR}$) may be 0.2. In this example, the NZCR threshold ($T_{NZCR}$) may be used to detect frames containing various high frequency speech components. For example, high frequency speech components may include various speech components, such as fricatives, voiced phonemes, plosives, and inspirations.

The exemplary method described herein may be used to detect frames containing high frequency speech components. BWE algorithms or other speech processing algorithms may use detected frames for improving clarity of a generated signal. For example, FDM 106 may be used in conjunction with a BWE algorithm to generate a WB speech signal from an NB speech signal. In this example, after detecting frames containing high frequency speech components, the BWE algorithm may estimate missing frequency components associated with the frames (e.g., related components having a frequency range outside of an NB speech signal). Using the estimated missing frequency components and the frames, a BWE algorithm may generate WB frames that sound more natural to a human listener.

Figure 5:
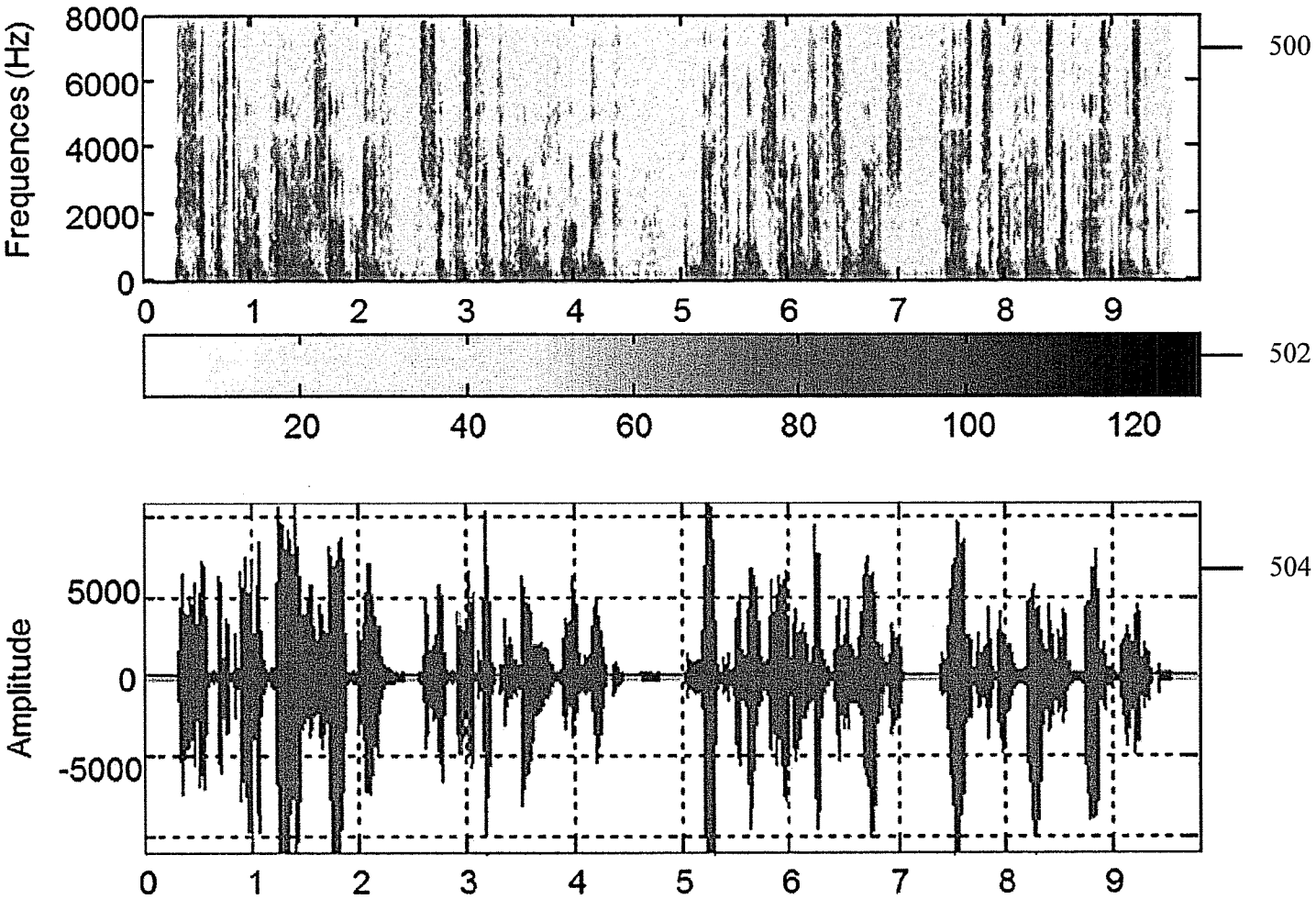
FIG. 5 includes diagrams illustrating spectral and energy characteristics of an exemplary speech signal.

FIG. 5 includes signal diagrams illustrating spectral and energy characteristics of an exemplary speech signal. In particular, FIG. 5 includes a spectrogram 500, a color meter 502, and an amplitude diagram 504. Spectrogram 500 depicts temporal and frequency information of a typical WB speech signal. In particular, the vertical axis represents frequencies while the horizontal axis represents time in seconds. The signal amplitude and frequency content may be proportional to the darkness of the picture as illustrated by the color meter 502. FIG. 5 also includes an amplitude diagram 504 for depicting signal amplitude of the WB speech signal over time. In particular, the vertical axis represents signal amplitude while the horizontal axis represents time in seconds.

In the exemplary WB signal depicted in FIG. 5, several frames have interesting high band components. For example, at or around 7 seconds, a fricative is depicted. As shown in spectrogram 500, the energy level at 7 seconds is significant in the high bands (e.g., between 3,000 Hz and 8,000 Hz) and is low in the low bands (e.g., below 3,000 Hz).

Figure 6:
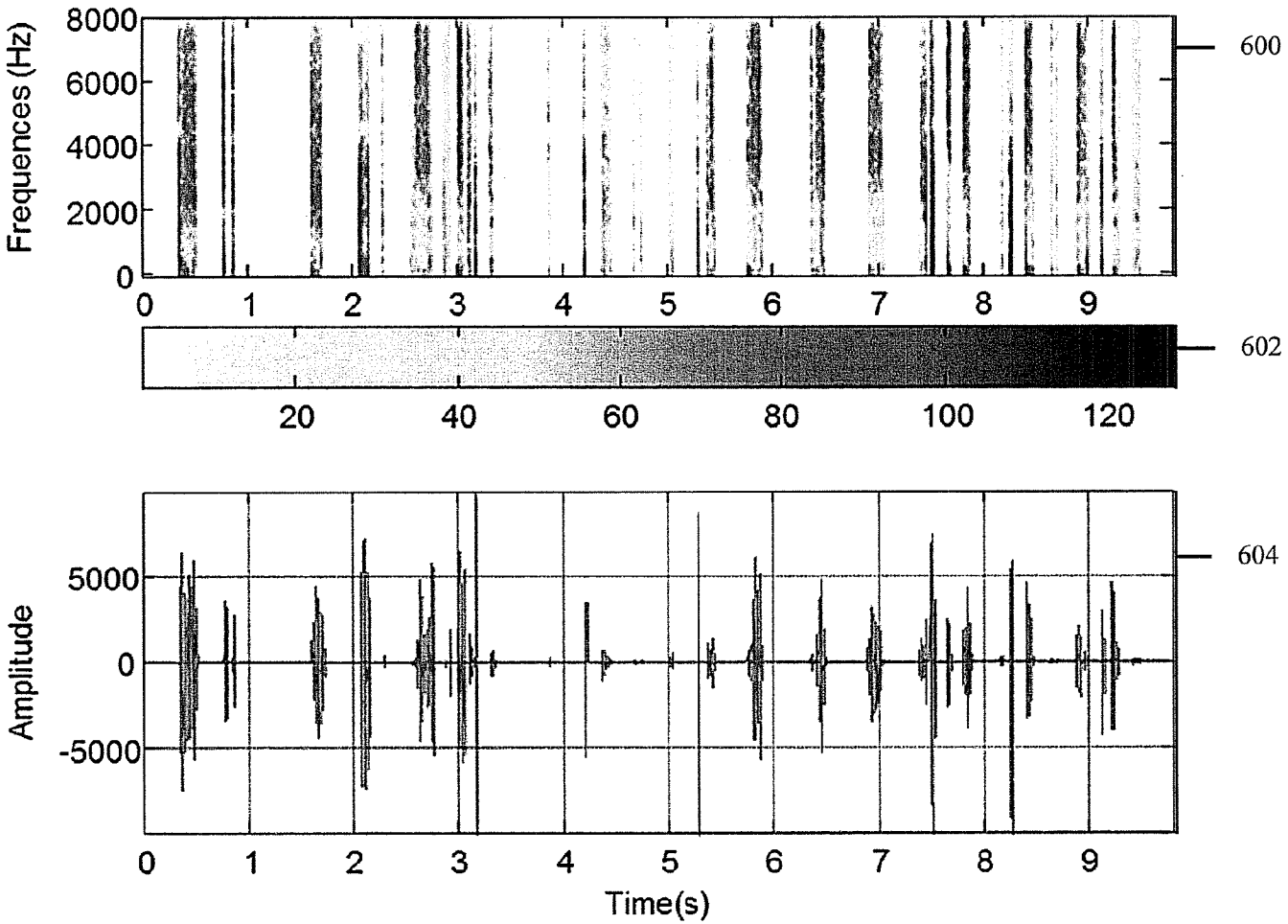
FIG. 6 includes diagrams illustrating frames containing high frequency speech components.

FIG. 6 includes diagrams illustrating frames containing high frequency speech components. In particular, FIG. 6 includes a spectrogram 600, a color meter 602, and an amplitude diagram 604. Spectrogram 600, color meter 602, and amplitude diagram 604 are similar to corresponding diagrams in FIG. 5. However, spectrogram 600 and amplitude diagram 604 FIG. 6 depicts frames of the exemplary WB signal containing high frequency speech components. For example, FIG. 6 may depict frames containing fricatives, inspirations (e.g., intake of air used for generating fricatives), and expirations (e.g., exhale of air during or after fricatives).

Figure 7:
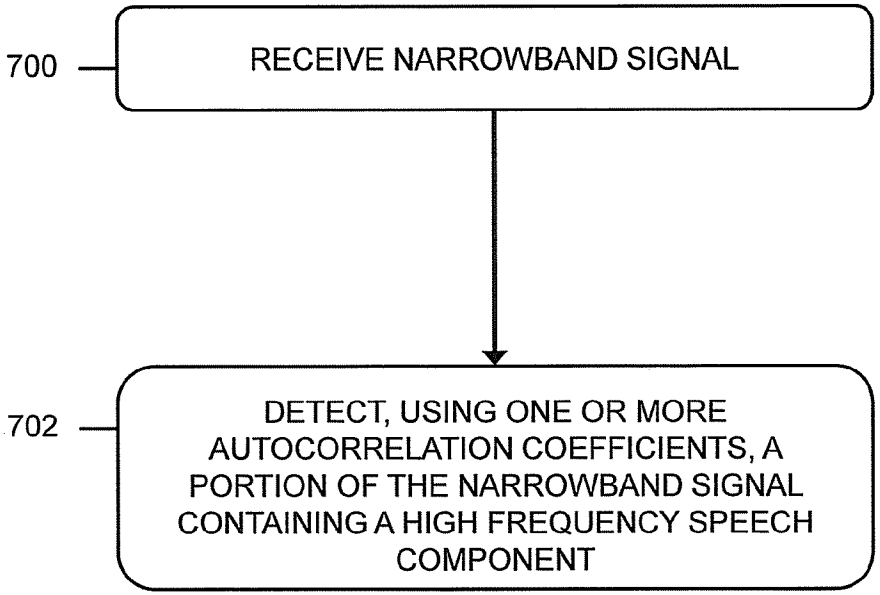
FIG. 7 is a flow chart illustrating an exemplary process for frequency detection according to another embodiment of the subject matter described herein.

FIG. 7 is flow chart illustrating an exemplary process for frequency detection according to another embodiment of the subject matter described herein. In some embodiments, one or more portions of the exemplary process may occur at or be performed by FDM 106.

Referring to FIG. 7, in step 700, an NB signal may be received. NB signal may include speech or voice communications. In some embodiments, NB signal may be up-sampled. For example, an NB signal with an 8,000 Hz sample rate may be converted to an NB signal having a 16,000 Hz sample rate by FDM 106. In a second example, a second module or node may perform the up-sampling before providing the up-sampled NB signal to FDM 106.

In step 702, a portion of the narrowband signal containing a high frequency speech component may be detected using one or more ACs. For example, ACs may be computed based on a windowed version of each frame of an up-scaled NB signal. In another example, previously calculated ACs may be retrieved. For instance, an AMR-WB or other CELP codec may compute ACs for LPC analysis. That is, ACs may be used to compute LPC coefficients, and, as such, may be available to FDM 106.

In yet another example, parameters, such as LPC coefficients and a final prediction error generated during LPC analysis, may be used to compute ACs. In this example, FDM 106 may extract such parameters (e.g., from a CELP decoder) when PCM samples are not available to compute ACs or when previously computed ACs are not available (e.g., from the decoder), In one embodiment, detecting the high frequency speech component includes analyzing one or more frames. For example, FDM 106 may detect a high frequency speech component for a frame of an up-sampled narrowband signal by determining whether the frame contains appropriate content for analysis and in response to determining that the frame contains appropriate content, determining, using a zero-crossing rate analysis of the ACs, whether the frame is associated with the high frequency speech component.

Figure 8:
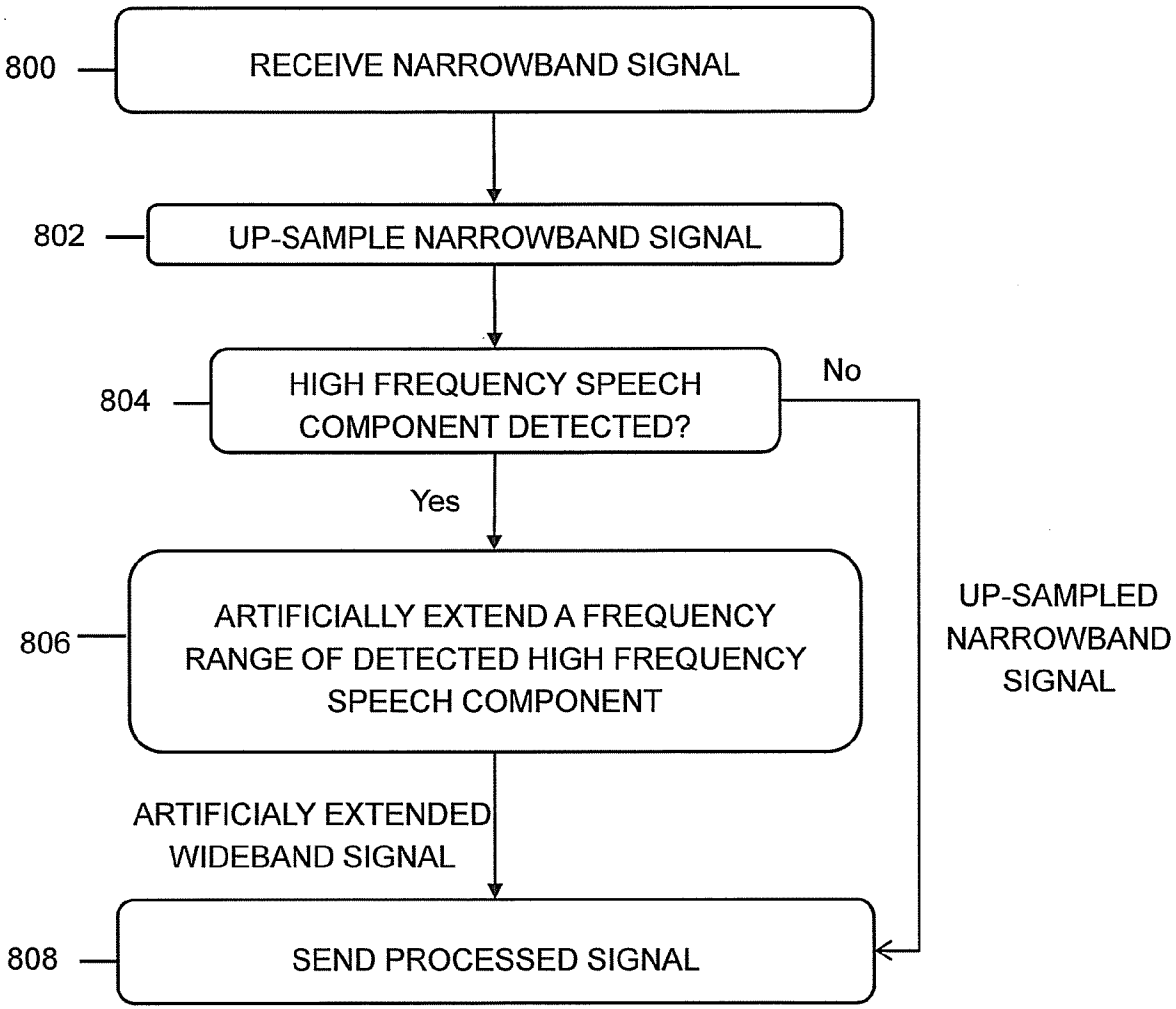
FIG. 8 is flow chart illustrating an exemplary process for bandwidth extension according to an embodiment of the subject matter described herein.

FIG. 8 is flow chart illustrating an exemplary process for bandwidth extension according to an embodiment of the subject matter described herein. In some embodiments, one or more portions of the exemplary process may occur at or be performed by a processor (e.g., DSP 104), a codec, a BWE module, FDM 106, and/or a communications node (e.g., a MG 102).

Referring to FIG. 8, in step 800, an NB signal may be received. NB signal may include speech or voice communications. In step 802, NB signal may be up-sampled. For example, an NB signal with an 8,000 Hz sample rate may be converted to an NB signal having a 16,000 Hz sample rate by a BWE module or an FDM 106.

In step 804, it may be determined whether a high frequency speech component is detected in the up-sampled NB signal. For example, a BWE module, a codec, or a communication node may receive an NB signal and may provide the NB signal or an up-sampled version of the NB signal to FDM 106 for detecting high frequency speech components. In another example, a BWE module may include frequency detection functionality as described herein. For instance, the BWE module may be integrated with FDM 106.

In step 806, if a high frequency speech component is detected, a frequency range of the detected high frequency speech component may be artificially extended. For example, using one or more various methods (e.g., codebook mapping, a neural network or Gaussian mixture model, a hidden Markov model, linear mapping, or other techniques, a BWE module may artificially extend a frequency range of a detected high frequency speech component. For instance, artificially extending a frequency range of a detected high frequency speech component may include estimating a missing frequency component associated with the detected high frequency speech component and generating a WB signal component based on the detected high frequency speech component and the estimated missing signal component.

In some embodiments, steps 804 and 806 may be performed one or more times. For example, a BWE module may generate multiple WB signal components before sending the WB signal including the wideband signal components to a destination, e.g., a mobile handset or VoIP application. In another example, a BWE module may send generated WB signal components as they become available, e.g., to minimize delay.

In step 808, a processed signal may be sent. For example, where a WB signal component is generated based on a detected high frequency speech component and an estimated missing signal component, the processed signal may include the generated WB signal component. In another example, where a high frequency speech component is not detected, the processed signal may be an up-sampled NB signal.

In some embodiments, a BWE module may process portions of a received NB signal associated with detected high frequency speech components. For example, the BWE module may artificially extend frequency ranges associated with NB signal portions containing high frequency speech components and may handle or process NB signal portions containing non-high frequency speech components (e.g., silence, strongly voiced phonemes, noise, etc.) differently. For instance, the BWE module may conserve resources by not artificially extending NB signal portions containing non-high frequency speech components.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A method for frequency detection, the method comprising:

receiving a narrowband signal; and detecting, using one or more autocorrelation coefficients, a portion of the narrowband signal containing a high frequency speech component;

wherein the narrowband signal is up-sampled to a target wideband (WB) signal sample rate and wherein the one or more autocorrelation coefficients are computed based on a portion of the up-sampled narrowband signal; and wherein detecting the high frequency speech component comprises determining whether the portion of the up-sampled narrowband signal contains appropriate content for analysis, and in response to determining that the portion contains appropriate content, determining, using a zero-crossing rate analysis of the autocorrelation coefficients, whether the portion is associated with the high frequency speech component.

2. The method of claim 1 wherein the high frequency speech component represents a fricative speech component.

3. The method of claim 1 wherein the high frequency speech component includes a speech component having a frequency at or above three thousand hertz.

4. The method of claim 1 wherein the one or more autocorrelation coefficients are computed based on a windowed version of the portion of the up-sampled narrowband signal.

5. The method of claim 1 wherein the one or more autocorrelation coefficients are computed by a module or a codec.

6. The method of claim 1 wherein determining whether the portion contains appropriate content includes determining whether an autocorrelation coefficient corresponding to variance of the portion exceeds a variance threshold.

7. The method of claim 1 wherein determining whether the portion contains appropriate content includes determining whether an autocorrelation coefficient ratio based on the portion exceeds an autocorrelation coefficient ratio threshold.

8. The method of claim 1 wherein the zero-crossing rate analysis is performed using the one or more autocorrelation coefficients.

9. The method of claim 1 wherein the method is performed at one of a digital signaling processor, a codec, and a media gateway.

10. The method of claim 1 comprising: artificially extending, by a bandwidth extension module, a frequency range of the detected high frequency speech component, wherein artificially extending the frequency range of the detected high frequency speech component includes estimating a missing frequency component associated with the detected high frequency speech component and generating a wideband signal component based on the detected high frequency speech component and the estimated missing frequency component.

11. The method of claim 10 wherein the bandwidth extension module handles non-high frequency speech components differently.

12. A system for frequency detection, the system comprising:

an interface for receiving a narrowband signal; and a frequency detection module for detecting, using one or more autocorrelation coefficients, a high frequency speech component associated with the narrowband signal;

wherein the frequency detection module generates an up-sampled narrowband signal based on the sample rate of a target wideband (WB) signal and wherein the frequency detection module computes the one or more autocorrelation coefficients based on the up-sampled narrowband signal; and wherein the frequency detection module detects the high frequency speech component for a portion of the up-sampled narrowband signal by determining whether the portion contains appropriate content for analysis; and in response to determining that the portion contains appropriate content, determining, using a zero-crossing rate analysis of the autocorrelation coefficients, whether the portion is associated with the high frequency speech component.

13. The system of claim 12 wherein the system is at least one of a digital signal processor (DSP) and a media gateway.

14. The system of claim 12 wherein the high frequency speech component represents a fricative speech component.

15. The system of claim 12 wherein the high frequency speech component includes a speech component having a frequency at or above three thousand hertz.

16. The system of claim 12 wherein the one or more autocorrelation coefficients are computed based on a windowed version of the portion.

17. The system of claim 12 wherein the one or more autocorrelation coefficients are computed by a module or a codec.

18. The system of claim 12 wherein determining whether the portion contains appropriate content includes determining whether an autocorrelation coefficient corresponding to variance of the portion exceeds a variance threshold.

19. The system of claim 12 wherein determining whether the portion contains appropriate content includes determining whether an autocorrelation coefficient ratio based on the portion exceeds an autocorrelation coefficient ratio threshold.

20. The system of claim 12 wherein the zero-crossing rate analysis is performed using the one or more autocorrelation coefficients.

21. The system of claim 12 wherein the system comprises a digital signaling processor, a codec, or a media gateway.

22. The system of claim 12 comprising: an bandwidth extension module configured to artificially extend a frequency range of the detected high frequency speech component by estimating a missing frequency component associated with the detected high frequency speech component and generating a wideband signal component based on the detected high frequency speech component and the estimated missing signal component.

23. The system of claim 22 wherein the bandwidth extension module handles non-high frequency speech components differently.

24. A computer readable medium comprising computer executable instructions embodied in a non-transitory computer readable medium and when executed by a processor of a computer performs steps comprising:

receiving a narrowband signal; and detecting, using one or more autocorrelation coefficients, a high frequency speech component associated with the narrowband signal;

wherein the narrowband signal is up-sampled to a target wideband (WB) signal sample rate and wherein the one or more autocorrelation coefficients are computed based on a portion of the up-sampled narrowband signal; and wherein detecting the high frequency speech component comprises determining, using a zero-crossing rate analysis of the autocorrelation coefficients, whether the portion of the up-sampled narrowband signal is associated with the high frequency speech component.

* * * * *